United States Patent [19]

Vidalenq

[11] Patent Number: 5,060,601

[45] Date of Patent: Oct. 29, 1991

[54] WATER-TUBE BOILER AND A HEATING INSTALLATION EQUIPPED WITH SUCH A BOILER

[76] Inventor: Maurice Vidalenq, 27, rue du Maréchal Joffre, 78430 Louveciennes, France

[21] Appl. No.: 500,748

[22] Filed: Mar. 28, 1990

[30] Foreign Application Priority Data

Mar. 28, 1989 [FR] France ..... 89 03980

[51] Int. Cl.[5] ..... F22D 7/00

[52] U.S. Cl. ..... 122/406.1; 122/235.15; 122/338; 122/448.3; 237/7

[58] Field of Search ..... 122/338, 235 D, 406 R, 122/448 B; 237/7

[56] References Cited

U.S. PATENT DOCUMENTS 585,545 6/1897 Watson ..... 122/338
3,628,508 12/1971 Kummel ..... 122/338 X
4,519,540 5/1985 Boulle et al. ..... 237/7

*Primary Examiner*—Edward G. Favors
*Attorney, Agent, or Firm*—Gottlieb, Rackman & Reisman

[57] ABSTRACT

A water-tube boiler is disclosed, comprising a body in which are located the furnace and a series of vertical tubes serving as heating and exchange surface between the furnace and the water to be heated flowing through these tubes, two respectively upper and lower manifolds to which the tubes are connected, and further comprising two independent water flows, one through the upper manifold to which the outgoing and return ducts of the heating circuits are connected, the other caused by thermosiphon action inside the tubes and the upper and lower manifolds.

5 Claims, 2 Drawing Sheets

WATER-TUBE BOILER AND A HEATING INSTALLATION EQUIPPED WITH SUCH A BOILER

BACKGROUND OF THE INVENTION

The present invention relates to a water-tube boiler and a heating installation equipped with such a boiler.

The most widely used central heating boilers at the present time comprise a series of vertical tubes forming the heating and exchange surface between the furnace and the water to be heated flowing through the tubes. The ends of these tubes are connected to two upper and lower manifolds, respectively. They also comprise a gas burner formed of a ramp or perforated pipe from which the air-gas mixture escapes and to the periphery of which the flames cling. The combustion products are removed horizontally about the tubes and they are collected in a circular smoke box communicating with a discharge duct.

A heating installation equipped with such boilers is characterized schematically by tubes connected to the upper and lower manifolds, themselves connected to an exchanger-mixer with a recycling pump whose purpose is to provide a very considerable water flow, so that all the vertical tubes of the boiler are individually well irrigated. The different circuits of the heating installation are connected to radiators, with inserted pumps.

It is essential for the flow of water through the boiler to be strictly constant so that the speed of the water in each tube is greater than Reynold's parameter.

If the installation comprises only one circuit, no problem arises, the water flow of the installation being adjusted once and for all.

If the installation comprises several circuits, which is the case of large installations, a shut-down of the flow in one or more of them causes the overall flowrate of the water penetrating into the boiler, so into the tubes, to vary, which results in possible vaporization points.

To overcome this drawback, an exchanger-mixer is used, mentioned above, with its circulating pump providing a constant flow of the water through the boiler.

The need to introduce this exchanger-mixer in the installation enters into the overall cost price for about 20%, to which must be added the cost of electricity consumption of the pump and its maintenance.

SUMMARY OF THE INVENTION

The object of the invention is to provide a boiler which overcomes the drawback of using primary water recycling in the installation with the use of an exchanger-mixer.

The basic principle of this new boiler consists in providing a water flow through the tubes which no longer depends on the flow of water through the radiators.

To arrive at this result, the present invention uses the motive force of the known thermosiphon system.

The invention provides then a water-tube boiler which is characterized by two independent water flows, one through the upper manifold to which the outgoing and return pipes of the heating circuit are connected, the other using thermosiphon action inside the tubes.

Consequently, the installer will economize on the installation of the primary circuit of the exchanger-mixer and he will be able to calculate his installation while disregarding the minimum flowrate imposed for boilers manufactured at the present time.

Condensation on the tubes, caused by "the dew point" resulting from the low temperature of the water in the return side of the installation entering a boiler in the prior art, always causes oxidation on the outside of the tubes and premature wear.

According to an important advantage of the invention, this condensation is suppressed, the returning water being immediately mixed with very hot water from the tubes.

BRIEF DESCRIPTION OF THE DRAWINGS

Other features, advantages and details of the invention will be described hereafter with reference to the accompanying drawings given by way of example and in which.

DESCRIPTION OF THE PREFERRED EMBODIMENT

Figure 1:
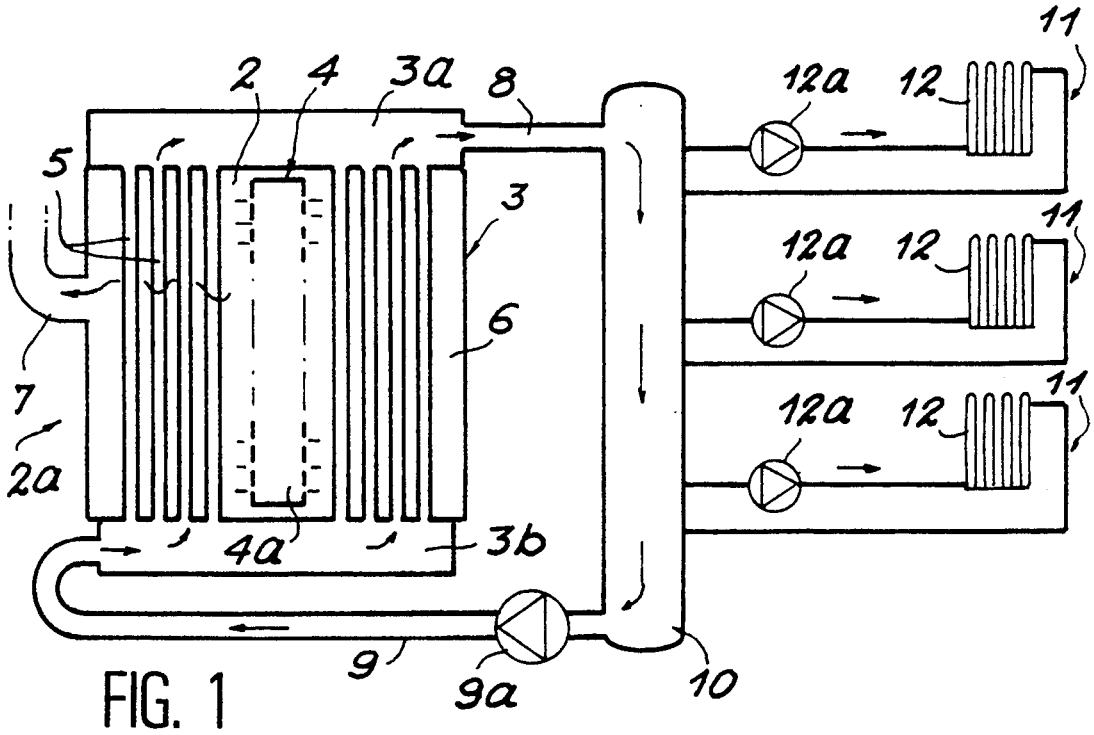
FIG. 1 is a schematic view of a heating installation equipped with a boiler according to the prior art.

The heating installation shown in FIG. 1 is equipped with a boiler 2*a* corresponding to the prior art and largely described above, with : a body 3 in which are housed the burner 4 including the perforated ramp or pipe 4*a;* the series of vertical tubes 5 forming the heating and exchange surface between the furnace 2 and the water to be heated flowing through tubes 5; the circular smoke box 6 and the discharge duct 7 therefor; the upper and lower manifolds 3*a* and 3*b;* the outgoing and return tubes 8 and 9 connected to the upper and lower manifolds; the pump 9*a;* and the heating circuits 11 with radiators 12 and pumps 12*a.*

Figure 2:
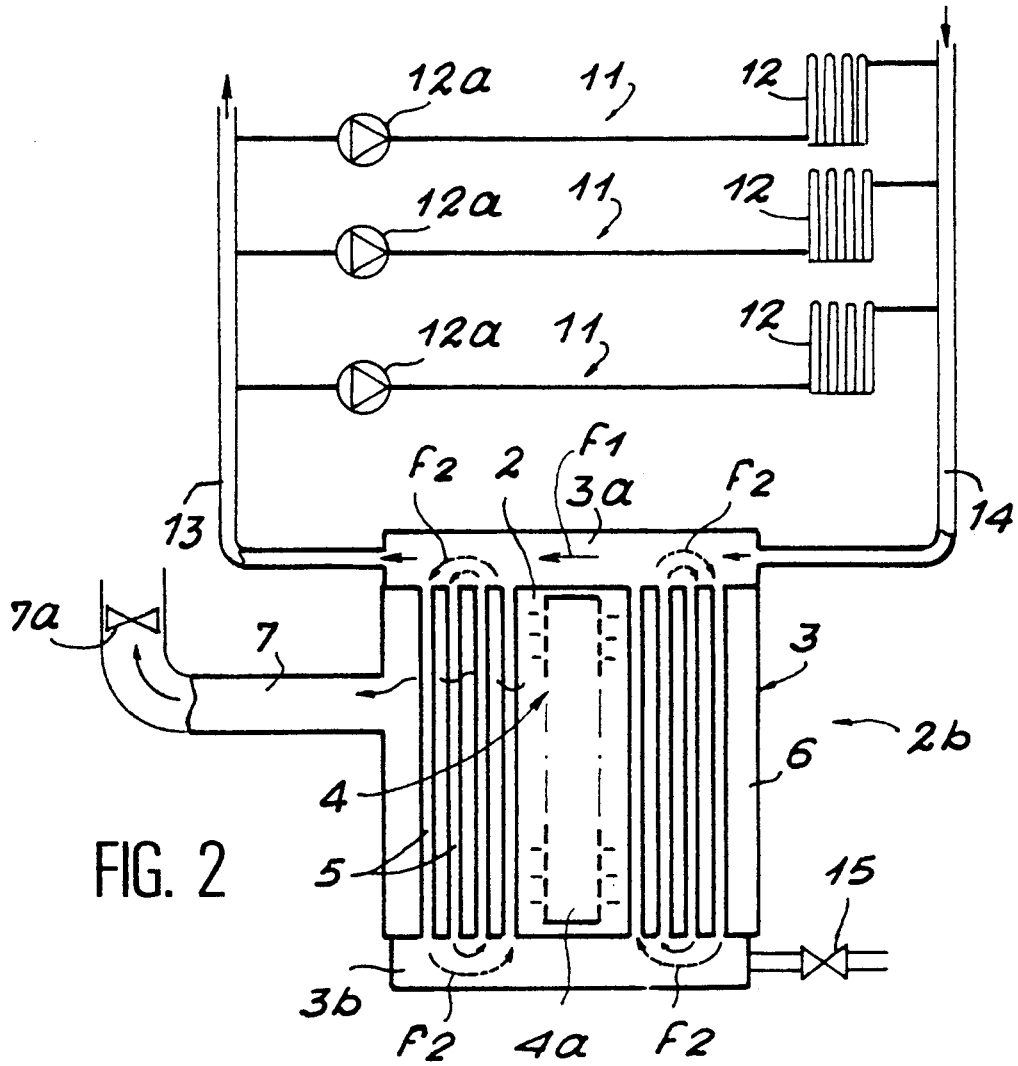
FIG. 2 is a schematic view of a heating installation equipped with a boiler according to the invention.

The heating installation shown in FIG. 2 is equipped with a boiler 2*b* according to the invention. This boiler 2*b* is constructed using the stack of tubes 5 as shown in FIG. 1 but connecting the outgoing duct 13 and the return duct 14 to the upper manifold 3*a* as shown in FIG. 2. The flow of water through this manifold 3*a* (arrows f1) becomes independent of the flow of water through tubes 5.

Furthermore, a self water flowing is created in tubes 5 by the tube to tube thermosiphon phenomenon. The water in tubes 5 placed close to burner 4 is heated to a temperature greater than that of the water in tubes 5 which are further away.

The flow rises in tubes 5 close to burner 4 and descends in the tubes 5 which are further away, as shown by arrows f2 in FIG. 2.

The circulating water in the heating circuit 11, 12, 13 and 14 of the installation and the very hot water from tubes 5 is mixed in the manifold 3*a.*

Manifold 3*a* serves as an exchanger-mixer replacing the exchange-mixer 10 of FIG. 1 which becomes superfluous.

In this new boiler 2*b*, the purpose of the lower manifold 3*b* is to provide the thermosiphon connection between tubes 5. A drain cock 15 is provided.

The simplified installation in FIG. 2 comprises no mixer 10.

A fan extractor 7*a* is advantageously provided in the discharge duct 7 so as to create a depression in the furnace 2.

To sum up, this boiler comprises two internal independent water flows, one going through the installation of the radiators, the other a thermosiphon flow in tubes 5.

Figure 3:
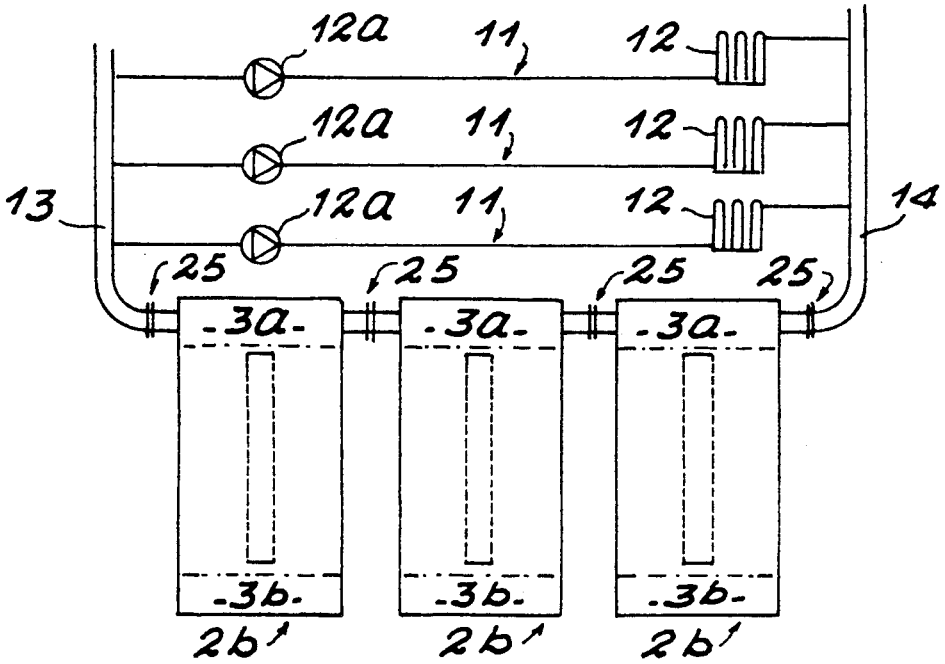
FIG. 3 is a schematic view of a heating installation equipped with several boilers according to the invention.

A heating installation may be equipped with several boilers 2*b* according to the invention which may be connected together by flanges 25 at the level of their upper manifolds 3*a* so as to form a single manifold-exchanger, as shown schematically in FIG. 3.

What is claimed is:

1. A water-tube boiler which includes a body in which are located a furnace providing a source of heat, a series of vertical tubes serving as heating and exchange surface between the furnace and the water to be heated flowing through these tubes, and two respectively upper and lower manifolds to which the tubes are connected; wherein the improvement comprises:

all of said tubes are located within said furnace, with some of them being located close to the source of heat and others being located further away from the source of heat so that the temperature of the water in said tubes decreases the further they are away from the source of heat;

said manifolds are connected with each other only through said tubes; and an outgoing duct and a return duct communicate with said upper manifold for conducting heated water therefrom out to, and cooled water back thereto from, a heating circuit;

whereby two independent water flows are provided in the boiler, one through the upper manifold from said return duct toward said outgoing duct, and the other between the upper and lower manifolds through the tubes caused by thermosiphon action inside the tubes and the upper and lower manifolds, with the temperature difference between the water in the various tubes serving to accelerate the thermosiphon action inside the tubes.

2. A water-tube boiler as claimed in claim 1, wherein the upper manifold serves as an exchanger-mixer, and the lower manifold serves to provide the thermosiphon connection between the tubes.

3. A water-tube boiler as claimed in claim 1, wherein the furnace comprises a gas burner with a ramp constituting said source of heat, a smoke box surrounding the series of tubes, and a discharge duct communicating with said smoke box, the combustion gases flowing from the gas burner horizontally over the tubes to the smoke box.

4. A water-tube boiler as claimed in claim 3, wherein a fan extractor is housed in the discharge duct so as to cause a depression in the furnace.

5. A heating installation of the type comprising several water-tube boilers such as defined in claim 1, wherein said boilers may be connected together by flanges at the level of their upper manifolds so as to form a single manifold-exchanger.

* * * * *